US005848572A

United States Patent [19]

Ito

[11] Patent Number: 5,848,572

[45] Date of Patent: Dec. 15, 1998

[54] SKIP STITCH PREVENTION APPARATUS FOR SEWING MACHINE

[75] Inventor: Hitoshi Ito, Sagamihara, Japan

[73] Assignee: Juki Corporation, Tokyo, Japan

[21] Appl. No.: 442,126

[22] Filed: May 16, 1995

[30] Foreign Application Priority Data

May 16, 1994 [JP] Japan ..... 6-100867

[51] Int. Cl.[6] ..... D05B 63/00

[52] U.S. Cl. ..... 112/199; 112/200; 112/260

[58] Field of Search ..... 112/162, 165, 112/197, 199, 163, 200, 260

[56] References Cited

U.S. PATENT DOCUMENTS

| | | | |
|---|---|---|---|
| 726,310 | 4/1903 | Klemm | 112/199 |
| 1,899,828 | 2/1933 | Rubel | 112/199 |
| 4,480,562 | 11/1984 | Von Hagen et al. | 112/165 X |
| 4,649,841 | 3/1987 | Koshinaka | 112/199 X |
| 4,690,080 | 9/1987 | Mikuni et al. . | |
| 5,398,627 | 3/1995 | Nishikawa | 112/165 X |
| 5,467,725 | 11/1995 | Fujita et al. | 112/162 |

*Primary Examiner*—Peter Nerbun

*Attorney, Agent, or Firm*—Morgan & Finnegan LLP

[57] ABSTRACT

A mechanism for a sewing machine for use in forming stitches by use of a looper thread which is controlled by a looper. This mechanism is adapted so that the looper thread which is run from a thread-thru hole to a stitch forming station is prevented from skipping over a needle penetrating point when a looper is moved upon descending of a needle, whereby stitches are formed without any skip stitch.

10 Claims, 10 Drawing Sheets

SKIP STITCH PREVENTION APPARATUS FOR SEWING MACHINE

FIELD OF THE INVENTION

This invention relates generally to sewing machines, and more particularly to an apparatus for preventing a skipping stitch in sewing. In particular, this invention relates to achieving a multi-thread chain stitch, a covering chain stitch and so on associated with a looper thread of a sewing machine.

DESCRIPTION OF THE PRIOR ART

Varieties of conventional sewing apparatus which are provided with a swingable looper relative to a reciprocating sewing needle so as to achieve certain stitches, such as the multi-thread chain stitch, the covering chain stitch, the over-edge chain stitch and the compound chain stitch, for example, are known.

A conventional scheme to accomplish a stitch by a looper will now be explained referring to a two-needle multi-thread chain stitch. FIGS. 10–13 show relations among needles, needle threads, a looper and a looper thread. As shown in FIGS. 10 and 11, each of a right and left needle thread is drawn out through a needle hole 5 in each of needles 4*a* and 4*b*, respectively, which reciprocate into a sewing hole 3 in a throat plate 2. A looper thread 6 is drawn out through a thread-thru hole 9 in a tip 8 of the looper 7 which is provided under the throat plate 2 and moves along a not-shown elliptic-like path. The looper 7 is accommodated so as to penetrate into the loops 10 formed by reciprocation of needle 4.

Here, the looper thread 6 is divided in two parts for further explanation hereinafter, one is a looper thread 6*a* which exists between a thread thru hole 9 in the tip 8 of the looper 7 and a knot 11 in a stitch, and the other is a looper thread 6*b* which starts from the thread thru hole 9 and runs along a side face of the looper 7 to a thread supplying core thread. The two threads 6*a* and 6*b* are designed so as to penetrate into the loop 10 of the thread 1.

The right needle 4*a* penetrates into a right penetrating point 13*a* in an area 14 surrounded by the looper 7, the looper thread 6*a* and a loop 10*a*, while the left needle 4*b* penetrates into a left penetrating point 13*b* in an area 15 surrounded by the looper 7, the looper thread 6*a*, the loop 10*a* and 10*b* shown in FIG. 11, so as to accomplish the multi-thread chain stitch.

Regarding the position of the looper thread 6 when the needles 4*a*, 4*b* move downward, the looper 7 starts to move backward, as indicated by a thick arrow in FIGS. 10 and 11, along a not-shown path. And then as shown in FIG. 12, the looper thread 6*a* follows the movement of the looper 7 and moves on toward the right penetrating point 13*a* departing from the knot 11. At this time, a normal stitch will be formed only when the right needle 4*a* penetrates into the area 14, while, as shown in FIG. 13, the normal stitch will not accomplished and the stitch will be skipped because the right needle 4*a* does not penetrate into the area 14 when the looper thread 6*a* follows the movement of the looper 7 and passes over the right penetrating point 13*a*.

To prevent the aforementioned disadvantage, a device is provided with a projection 15 on the undersurface of the throat plate 2 near the sewing hole 3 to hook both the looper thread 6*a* and the needle thread 1 extending from a stitch as shown in FIG. 14, a thread manipulator 16 which hooks both the looper thread 6*a* and the needle thread 1 as shown in FIG. 15, and a skipping stitch preventing device capable of adjusting the tightness and the looseness of the thread 6 by a looper thread drawing device 18 which is provided with an adequately designed looper thread drawing cam 17 as shown in FIG. 16, have been disclosed.

However, the aforementioned first device has a disadvantage that the sewing operation rubs both the needle thread 1 and the looper thread 6 with the projection 15 and this rubbing tears fibers from these threads or breaks these threads. The aforementioned second device also has a disadvantage that this sort of sewing apparatus has to be provided with a looper controlling mechanism, which is disclosed in U.S. Pat. No. 5237942, for example, besides the manipulator 16 and so this may result in apparatus that cannot be inexpensively and easily manufactured or thereafter adjusted.

Further, in a sewing apparatus specified for the multi-thread chain stitch or the covering chain stitch, a disadvantage of the looper thread drawing device 18 with the conventional looper thread drawing cam 17 is that the device is able to accomplish normal stitches without a skipping stitch only when the tightness and the looseness of the thread 6 are adequately adjusted to the characteristics of thread itself, but only one variety of the cam 17 cannot deal with the vast varieties of the required adjustments which vary with the nature of the thread 6.

In a multi-function sewing apparatus mentioned in U.S. Pat. No. 5,255,622 which accomplish two different stitches individually such as the multi-thread chain stitch or the covering chain stitch and the other stitch except these two stitches, especially in the multi-function sewing apparatus specified for the multi-thread chain stitch or the covering chain stitch and an over casting, for example, it is almost impossible to accommodate the looper thread drawing cam 17 so that the looper 7 serves as a looper for both the multi-thread chain stitch or the covering chain stitch and the over casting. If it is possible to accommodate it, considering the structure for the over casting, the looper thread drawing cam 17 should be provided near the left end of the not-shown main shaft of the sewing apparatus and a path of the looper thread 6 from the thread core to the looper 7 for the multi-thread chain stitch or the covering chain stitch should be largely different from that of the over casting. These two different paths sacrifice the utility of the sewing apparatus and this becomes a serious disadvantage. A swingable take-up lever as the looper thread drawing device does not sacrifice the utility, however, the swingable take-up lever also cannot control the tightness and the looseness of the thread 6 freely on demand. This problem causes the undesirable swing of the thread 6 and brings the skipping stitch as a result.

SUMMARY OF THE INVENTION

It is an object of the present invention to provide an apparatus capable of preventing skipping stitch and to accomplish fine stitches steadily.

The above and other objects are achieved according to the present invention by providing the apparatus with a first looper thread blocking device or with both the first and a second looper thread blocking device on the undersurface of a throat plate to prevent further progress of a looper thread so as not to pass over a penetrating point when the looper thread follows the movement of the looper as a needle moves downward.

DETAILED DESCRIPTION OF THE DRAWINGS

Alternative embodiments of the invention will be described hereinafter in connection with the illustrated working models, the equivalents and the counterparts to the aforementioned conventional ones have the same identification number throughout the drawings.

Figure 1:
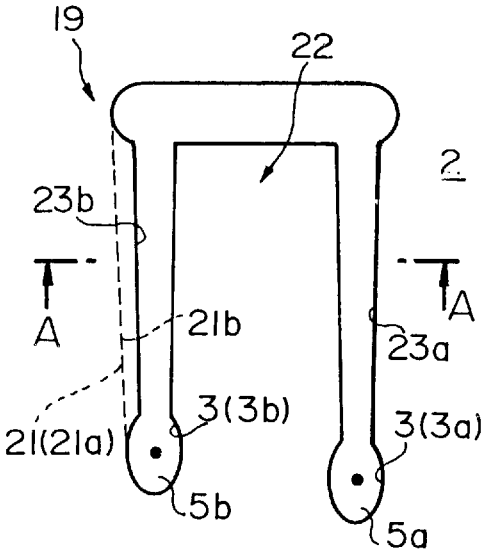
FIG. 1 illustrates the first working model for the two-needle multi-thread chain stitch or the two-needle covering chain stitch.
Figure 2:
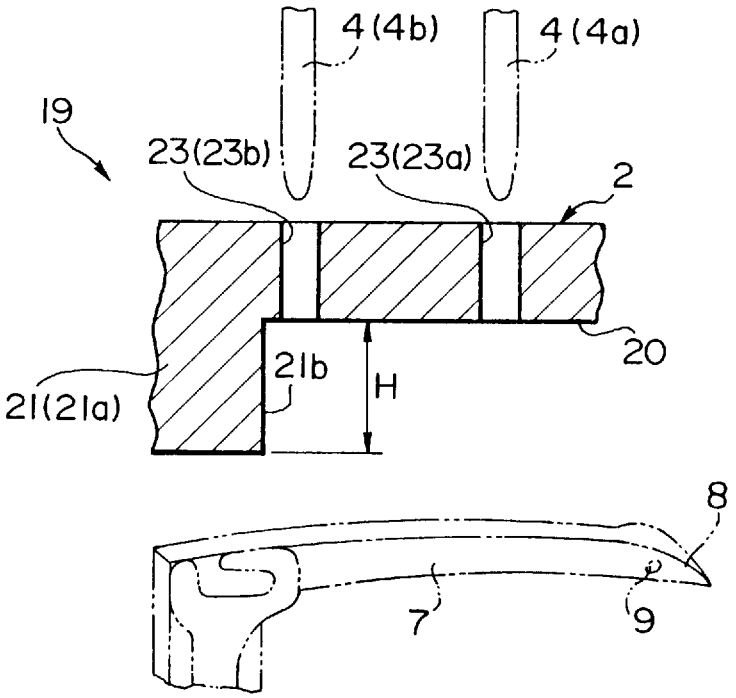
FIG. 2 is an enlarged cross section view A—A of FIG. 1.

In one embodiment of the present invention, the apparatus for preventing a skipping stitch 19 is, as shown in FIGS. 1 and 2, a single component which projects a first looper thread blocking device 21 from the undersurface of the throat plate 2 which faces the looper 7 so as to obstruct the way of the looper thread which follows the movement of the looper after looper 7 catches the looper thread 6.

Further referring to FIGS. 1 and 2, two sewing holes 3*a* and 3*b* are made in a seaming part 22 of the throat plate 2 for the penetration of the needle 4*a* and 4*b*, and there are two slots 23*a* and 23*b* starting from the sewing hole 3*a* and 3*b* respectively and extending along the feeding direction of the sewing apparatus to release the stitches. A projection 21*a* extends downwards at a place near the slot 23*b* and far from the tip 8 of the looper 7. The projection 21*a* has a wall surface 21*b* running almost parallel with the slot 23*b* and the height H of the projection 21*a* should be determined, 1mm for example, so as to not hit the looper 7.

Figure 3:
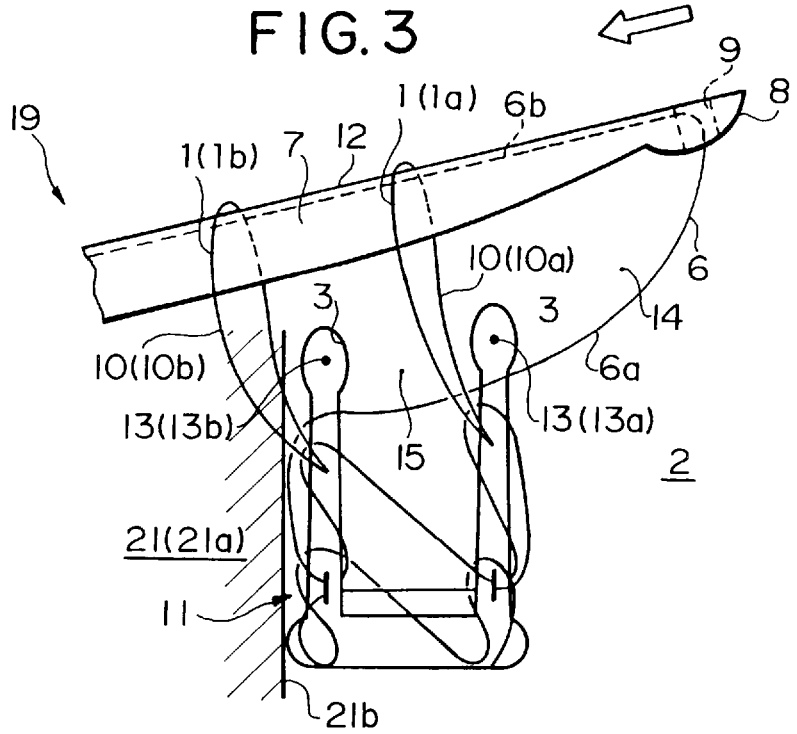
FIG. 3 illustrates a top view of the throat plate when the needle starts to move downward in the first working model.
Figure 4:
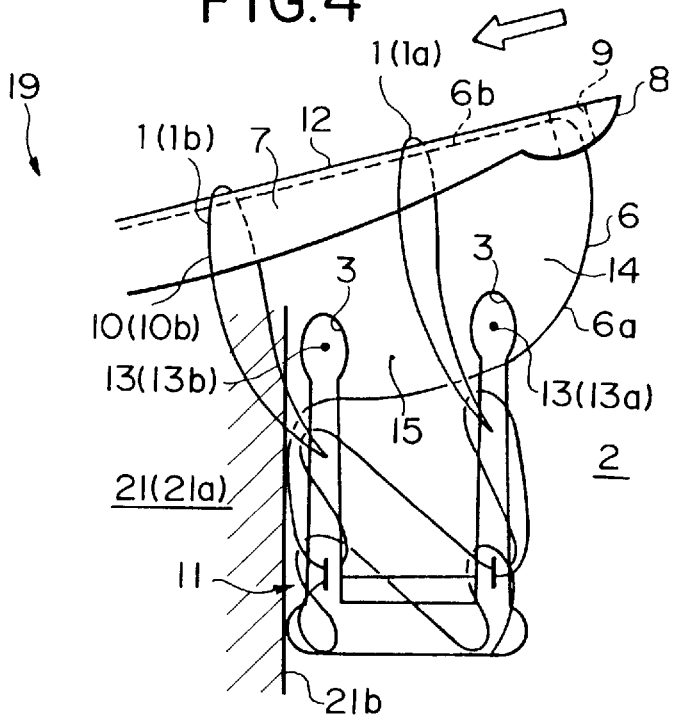
FIG. 4 also illustrates the same view of FIG. 3 as the needle penetrates into the sewing hole.

Following is an explanation for the working of one embodiment of the present invention referring to FIGS. 3 and 4. As shown in FIG. 3, the right needle thread 1*a* and the left needle thread 1*b* are drawn out through the needle hole 5 in each needle penetrating into the sewing holes 3*a* and 3*b* respectively, the same as for a conventional one. The looper thread 6 is also drawing out through the thread through hole 9 in the tip 8 of the looper 7 which is provided under the throat plate 2 and moves along a not-shown assigned path. The tip 8 of the looper 7 is accommodated so as to penetrate into the loops 10*a* and 10*b* formed by the reciprocation of needles 4*a* and 4*b*. That is, both the looper thread 6*a* and the thread 6*b* are moved so as to penetrate into the loops 10*a* and 10*b*.

Figure 10:
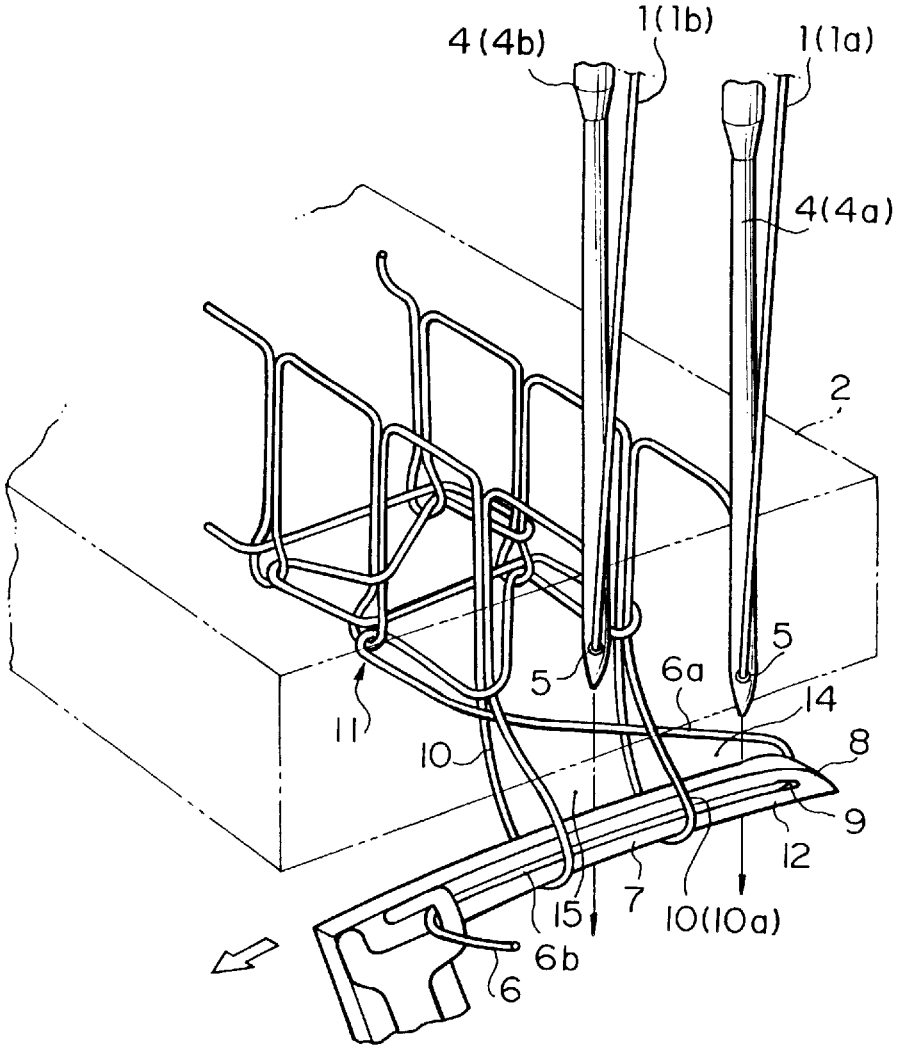
FIG. 10 illustrates a relation among a needle, a needle thread and a looper thread when the needle starts to move downward in a conventional two-needle multi-thread chain stitch.
Figure 11:
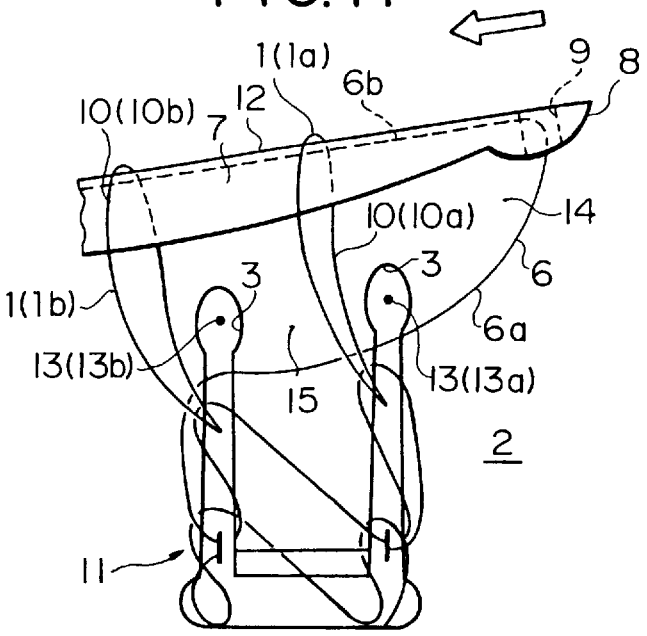
FIG. 11 illustrates a bottom view of the throat plate of FIG. 10.
Figure 12:
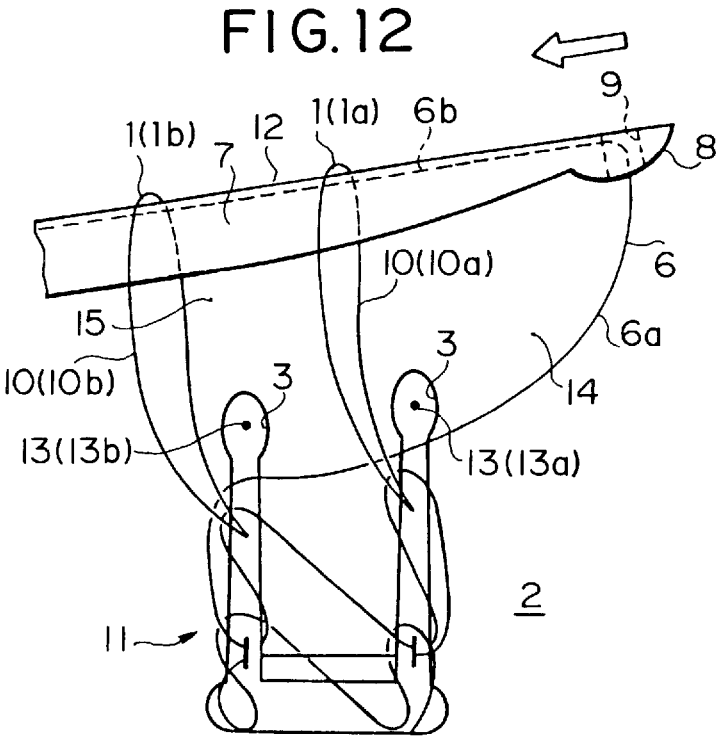
FIG. 12 also illustrates the same view of FIG. 11 when the needle reached a certain point on the way to penetration.
Figure 13:
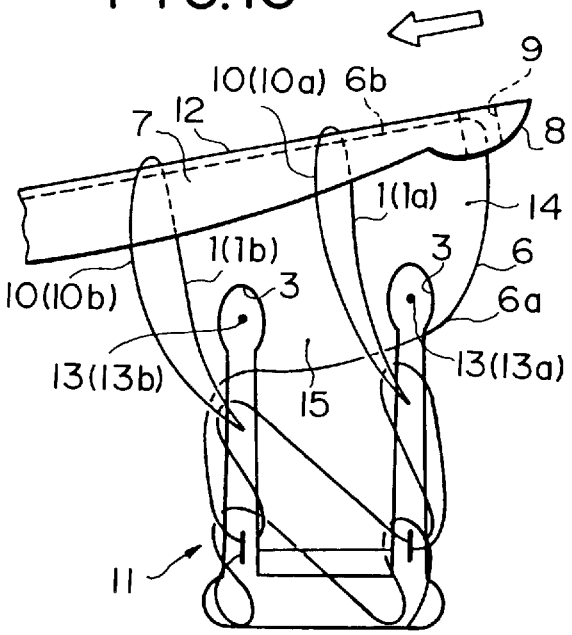
FIG. 13 illustrates the same view of FIG. 11 when the needle penetrates into the sewing hole.
Figure 14:
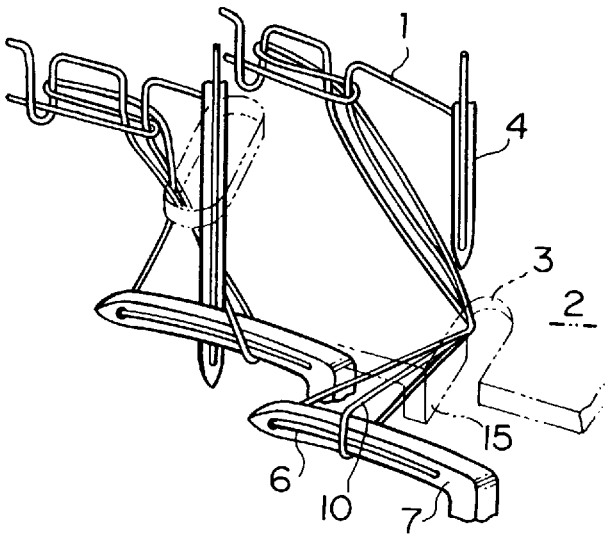
FIGS. 14, 15 and 16 illustrate prior art apparatus to prevent the skipping stitch.
Figure 15:
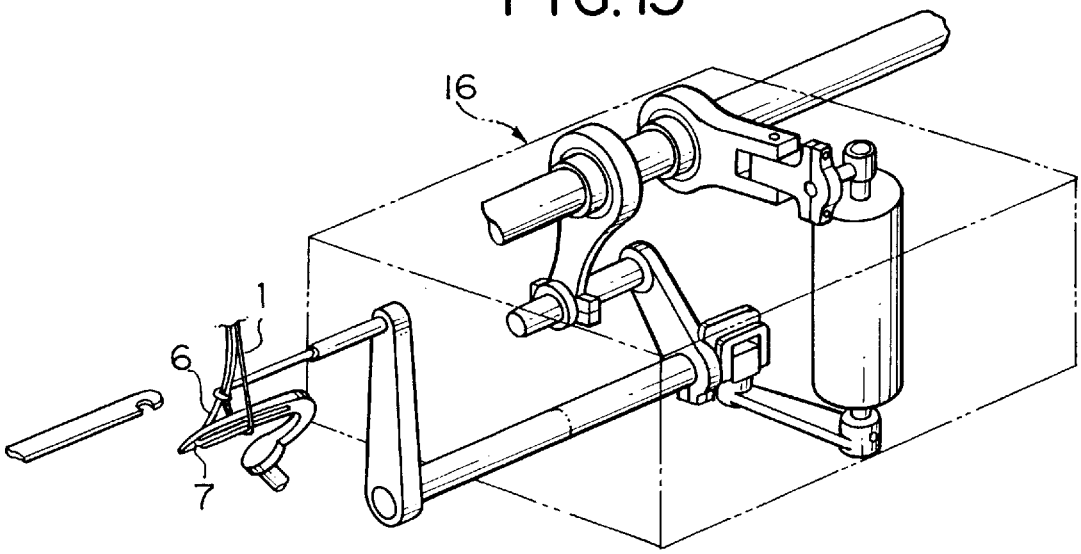
Figure 16:
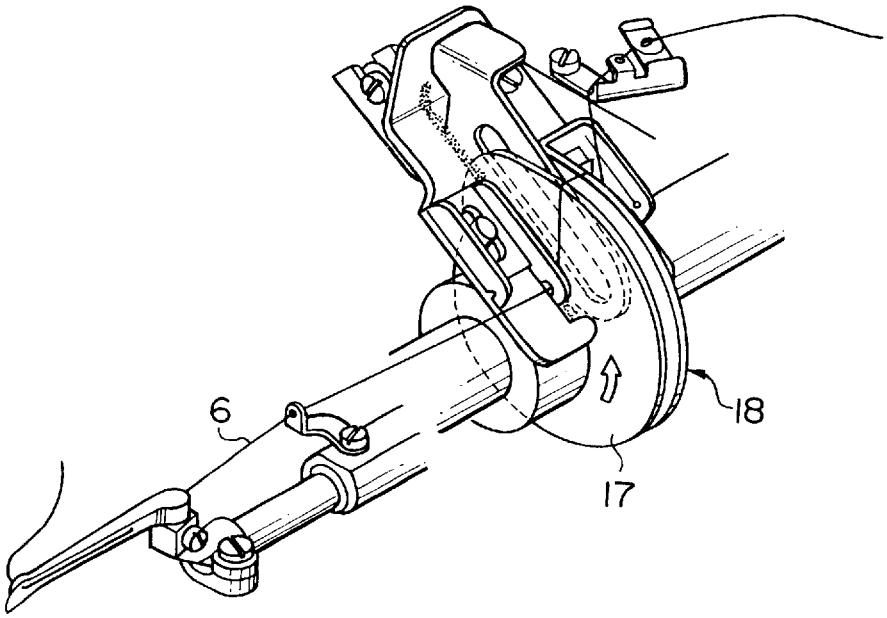
Figure 17:
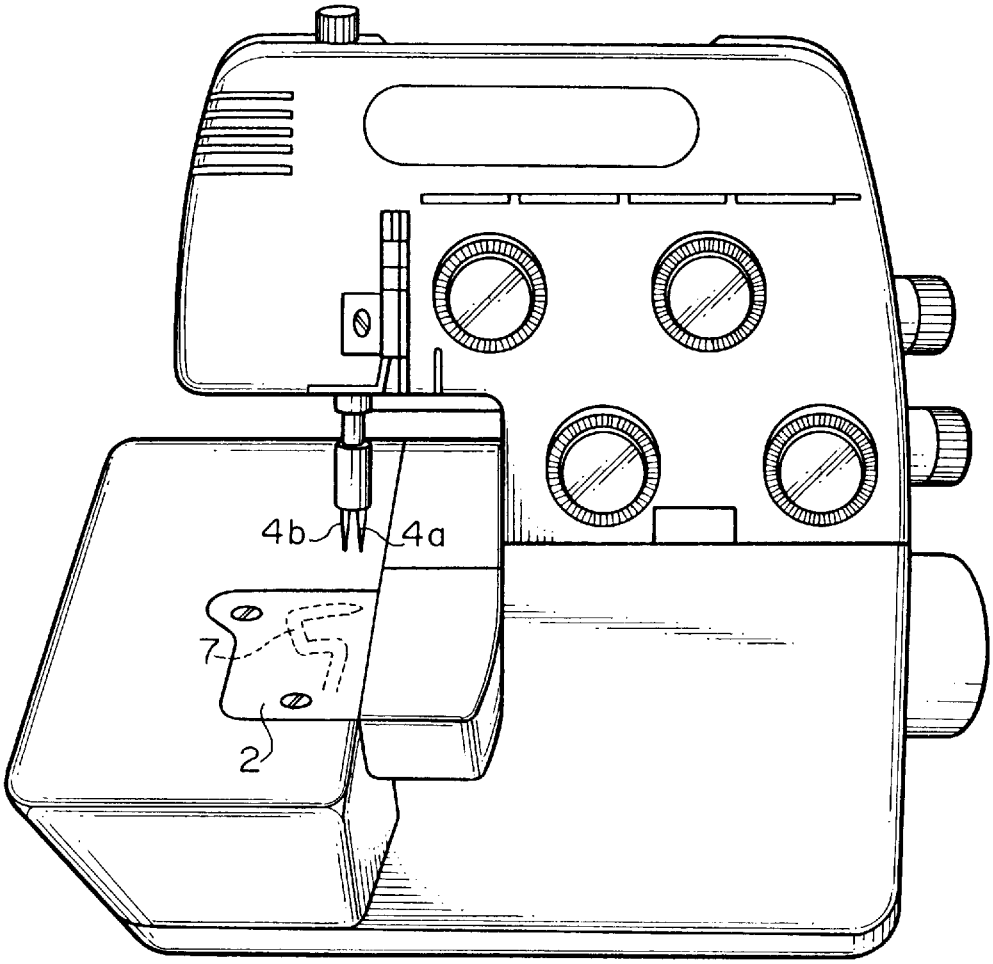
FIG. 17 is perspective view showing a over-lock sewing apparatus in which the present invention is applied.

The right needle 4*a* which is located near the tip 8 penetrates into the right penetrating point 13*a* in the area 14 and the left needle 4*b* which is located far from the tip 8 also penetrates into the left penetrating point 13*b* in the area 15, as shown by the arrows in FIG. 10, thus the multi-thread chain stitch is accomplished.

Then, the looper 7 starts to move backward along a not-shown assigned path, as indicated by the thick arrow in FIG. 3, as the needles 4*a*, 4*b* start to move downward. The looper thread 6*a* follows the movement of the looper 7, as a matter of course. At this moment, the wall surface 21*b* of the projection 21*a* of thread blocking device 21 bars the way of the looper thread 6*a* so that the looper thread 6*a* does not pass it over. And then, the needle 4*a* penetrates into the sewing hole as the looper 7 progresses further, as shown in FIG. 4.

That is, as shown in FIG. 4, the wall surface 21*b* of the projection 21*a* obstructs further progress of the looper thread 6*a* accompanied with the movement of the looper 7, and so the looper thread 6*a* slackens and also moves to a position far from the right penetrating point 13*a*. Thus, the area 14 is widely formed rather than that of a conventional sewing apparatus. In this manner, the projection 21*a* certainly prevents the looper thread 6*a* from passing over the right penetrating point 13*a* near the tip 8 of the looper 7, and so it allows a sewing apparatus to accomplish the high quality seam of the smaller pitch of the multi-thread stitch or the covering chain stitch easily.

The apparatus for preventing a skipping stitch 19 of this embodiment is provided with the simpler looper thread blocking device 21 which obstructs the swing of the looper thread 6*a*, and so it resolves all of the aforementioned disadvantages in the prior art.

Figure 5A:
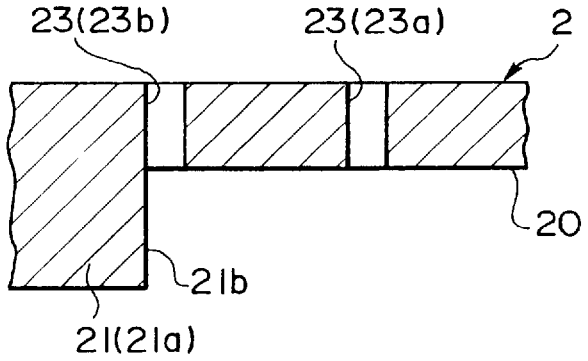
FIGS. 5A, 5B and 5C illustrate enlarged cross section views of a working model of the apparatus respectively.

Other alternative embodiments for the thread blocking device 21 will now be explained referring to FIG. 5A–5C:

The projection 21*a* is extended along the one of two sides of the slot 23*b* in FIG. 5A.

Figure 5B:
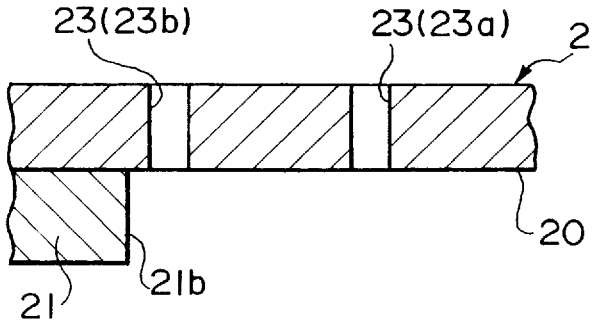

The discrete projection 21*a* is affixed on the undersurface of the throat plate 2 by screw or adhesive or welding and so on, in FIG. 5B.

Figure 5C:
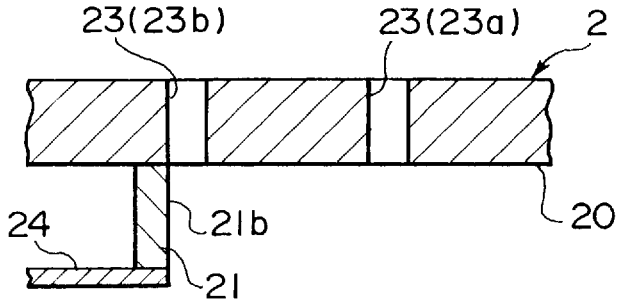

An adequately designed supporting tool 24 is provided so as to keep the discrete projection 21*a* in the right position in FIG. 5C.

The discrete projection 21*a* can be made from vast varieties of materials such as metal, plastic, glass, ceramics and rubber, for example.

Figure 6:
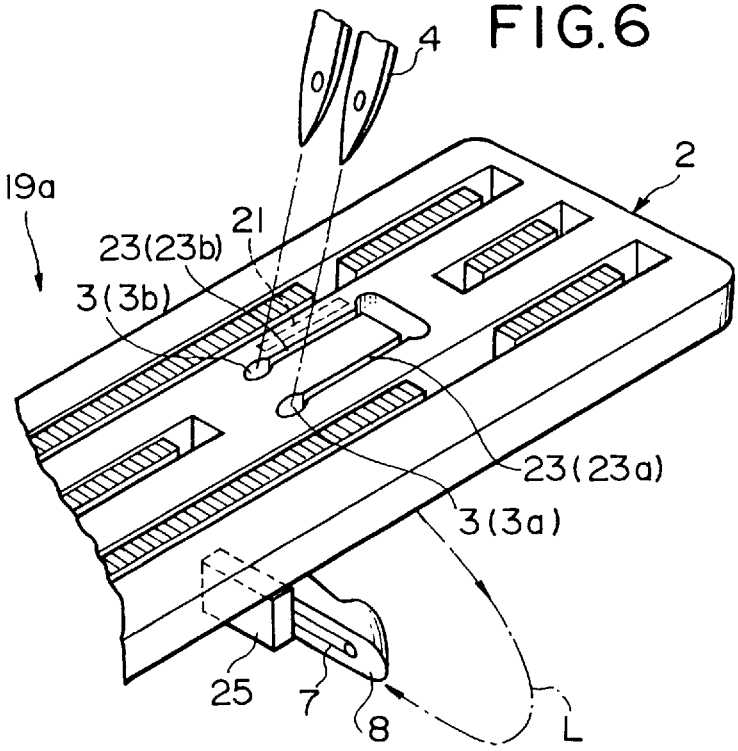
FIG. 6 illustrates an oblique view of the second working model applied for the two-needle multi-thread chain stitch or the two-needle covering chain stitch.
Figure 7:
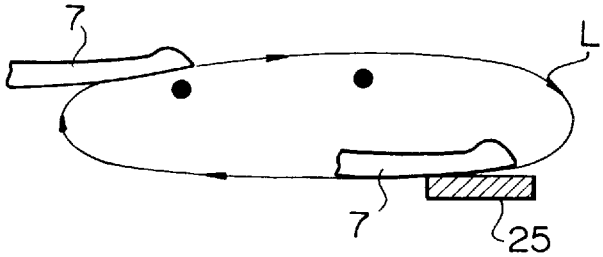
FIG. 7 illustrates the looper path against the looper thread blocking device.

Another alternative embodiment of the present invention illustrates a second working model for a two-needle multi-thread chain stitch and a two-needle covering chain stitch relative to this invention is shown in FIGS. 6 and 7.

The apparatus for preventing skipping stitch of the second working model includes the first looper thread blocking device 21 and a second looper thread blocking device 25 capable of barring the looper thread 6*a* from passing over the looper 7 as it follows the movement of the looper 7, which is on the undersurface of the throat plate 2.

As will now be explained further referring to FIGS. 6–9, the second looper thread blocking device 25 is provided so as to face the side face 12 of the looper 7 near the swing back path L of the looper 7 relative to the needle penetration. The other structure is the same as for the aforementioned first working model.

The looper 7 starts to move backwards along the swing back path L as the needles 4*a*, 4*b* start to move downwards, and so the looper thread 6*a* follows the looper 7, of course. The projection 21*a* stands ahead of the way of the looper thread 6*a* so that the further progress of the thread is prevented at the projection. And then, as the looper 7 progresses backwards further, the looper thread 6*a* approaches the looper 7 as the thread 6*a* moves into the other side of the looper 7 through the thread thru hole 9 because of the nature of the thread such as stiffness, as shown as a dotted line in FIG. 8. Then, the thread 6*a* finally passes over the right penetrating point 13*a* located near the tip 8 and thus the skipping stitch will not occur.

Figure 8:
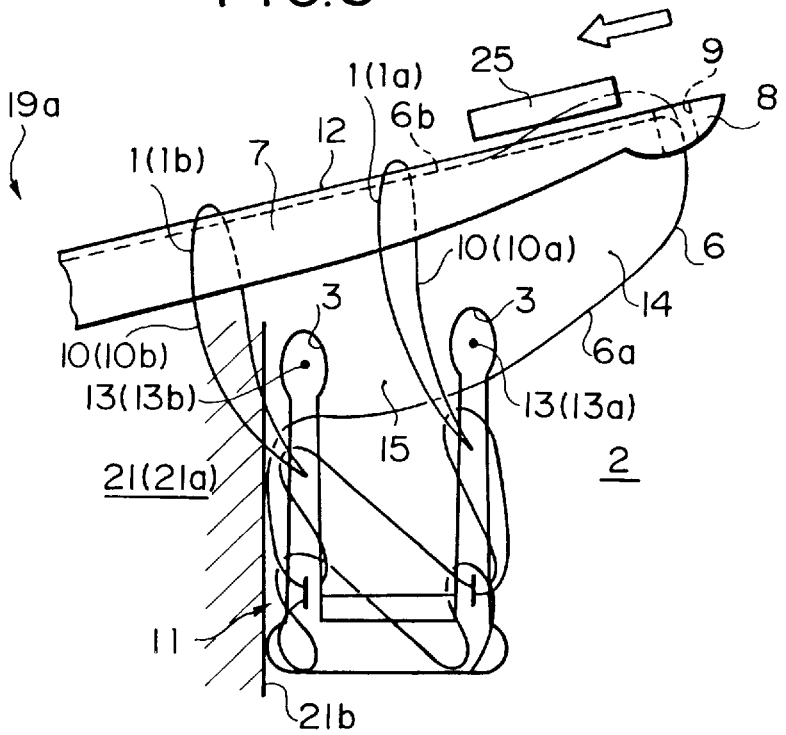
FIG. 8 is a detailed showing of a bottom view of the throat plate in the second working model when the needles reached a certain point on the way to penetration.
Figure 9:
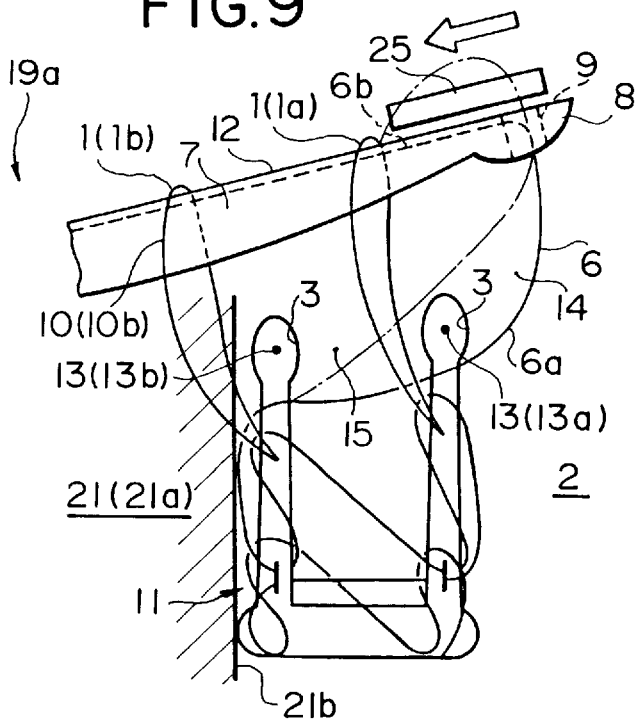
FIG. 9 also illustrates the same view of FIG. 8 as the needle penetrates into the sewing hole.

In accordance with the working model, the second looper thread blocking device 25 certainly prevents the skipping stitch by obstructing the movement of the thread 6*a* through the thread thru hole 9, shown in FIGS. 8 and 9.

From the foregoing, it will be appreciated that a preferred embodiment has been disclosed for a apparatus for preventing skipping stitch. It is to be appreciated that alternative apparatus may be substituted for elements of the preferred embodiment without departing from the scope of the present invention.

We claim:

1. Apparatus for preventing a skipping stitch in a sewing machine having a throat plate, which accomplishes a seam relative to a reciprocating sewing looper, said apparatus comprising:

a first looper thread blocking device having a surface which is fixed to an under-surface of a throat plate for preventing a looper thread, which exists between a thread-thru hole in a tip of said sewing looper and a stitch forming station, from passing over a penetrating point of a sewing needle as said sewing needle moves downward.

2. Apparatus for preventing a skipping stitch in a sewing machine having a throat plate, which accomplishes a seam relative to a reciprocating sewing looper, said apparatus comprising:

a first looper thread blocking device for preventing a looper thread, which exists between a thread-thru hole in a tip of said sewing looper and a stitch forming station, from passing over a penetrating point of a sewing needle as said sewing needle moves downward; and a second looper thread blocking device for preventing said looper thread from moving into a side of said sewing looper through said thread thru-hole as said sewing needle moves downward.

3. The apparatus of claim 1 wherein said first looper thread blocking device extends along one of two sides of a slot in said throat plate.

4. The apparatus of claim 1 wherein said first looper thread blocking device is affixed on an undersurface of said throat plate by a fastening means.

5. The apparatus of claim 1 wherein said first looper thread blocking device is supported by a supporting portion so as to keep said blocking device in position.

6. Apparatus for preventing a skipping stitch in a sewing machine having a throat plate, which accomplishes a seam relative to a reciprocating sewing looper, said apparatus comprising:

a first looper thread blocking device having a surface which is fixed to an undersurface of a throat plate to prevent a looper thread from passing over a penetrating point of a sewing needle.

7. Apparatus for preventing a skipping stitch in a sewing machine having a throat plate, which accomplishes a seam relative to a reciprocating sewing looper, said apparatus comprising:

a first looper thread blocking device having a surface positioned opposite to a backward path of said looper and over a movement path of said looper to prevent a looper thread from passing over a penetrating point of a sewing needle; and a second looper thread blocking device for preventing said looper thread from moving into a side of said sewing looper through thread thru-hole as sewing needle moves downward.

8. The apparatus of claim 6 wherein said first looper thread blocking device extends along one of two sides of a slot in said throat plate.

9. The apparatus of claim 1 further comprising:

a second looper thread blocking device for preventing a looper thread from moving into side of said sewing looper through said thread thru-hole as said sewing needle moves downward.

10. An apparatus for preventing a skipping stitch in a sewing machine having a throat plate, which accomplishes a seam relative to a reciprocating sewing looper moving along a first plane, said apparatus comprising:

a first looper thread blocking device having a surface lying in a second plane which intersects said first plane; and a second looper thread blocking device for preventing a looper thread from moving into a side of said sewing looper through thread thru-hole as sewing needle moves downward.

* * * * *